US006007120A

United States Patent [19]

Vogt et al.

[11] Patent Number: 6,007,120

[45] Date of Patent: Dec. 28, 1999

[54] CLAMPING RING WITH REMOVABLE HANDLE

[76] Inventors: Randall L. Vogt, 57765 Hwy. 4, P.O. Box 301, Plymouth, Nebr. 68424; Michael D. Hartley, 411 N. 17th St., Beatrice, Nebr. 68310; Delmar R. Wiese, 1946 S. Thelma, Springfield, Mo. 65807

[21] Appl. No.: 09/112,736

[22] Filed: Jul. 9, 1998

[51] Int. Cl.[6] ..... B65D 45/30

[52] U.S. Cl. ..... 292/256.69; 292/DIG. 27; 292/256.65

[58] Field of Search ..... 292/256.69, 256.65, 292/256.6, DIG. 49, 336.3, 256.73, 256.75, 256.67, DIG. 27; 24/270, 271, 273

[56] References Cited

U.S. PATENT DOCUMENTS

| | | | |
|---|---|---|---|
| D. 308,008 | 5/1990 | Bissell | D8/72 |
| D. 309,109 | 7/1990 | Allen | D9/436 |
| 1,148,472 | 7/1915 | Adams | 24/270 |
| 2,453,492 | 11/1948 | Carter | 292/256.69 |
| 2,482,374 | 9/1949 | Ruschmeyer | 24/271 |
| 2,981,977 | 5/1961 | Fannen | 292/256.69 |
| 3,770,157 | 11/1973 | Setele | 217/44 |
| 4,101,156 | 7/1978 | Santoni | 292/256.69 |
| 4,186,468 | 2/1980 | Zaniewski | 24/243 B |
| 4,205,761 | 6/1980 | Gerster | 220/321 |
| 4,413,850 | 11/1983 | Siblik | 292/256.69 |
| 4,623,458 | 11/1986 | Hakola | 210/238 |
| 4,646,931 | 3/1987 | Andrews et al. | 220/320 |
| 5,002,002 | 3/1991 | Awalt, Jr. | 114/210 |
| 5,129,537 | 7/1992 | Bordner et al. | 220/321 |
| 5,217,264 | 6/1993 | Fier | 292/142 |
| 5,219,088 | 6/1993 | Reina | 220/321 |
| 5,284,270 | 2/1994 | Kusta | 220/321 |
| 5,295,604 | 3/1994 | Van Ryswyk | 220/321 |
| 5,297,444 | 3/1994 | Kriner et al. | 74/520 |
| 5,299,707 | 4/1994 | Stolzman | 220/321 |
| 5,323,515 | 6/1994 | Baekdahl | 24/279 |
| 5,329,673 | 7/1994 | Mason | 24/279 |
| 5,411,162 | 5/1995 | Koziczkowski et al. | 220/320 |

FOREIGN PATENT DOCUMENTS

| | | | |
|---|---|---|---|
| 420113 | 11/1934 | United Kingdom | 292/256.65 |

*Primary Examiner*—Darnell M. Boucher
*Assistant Examiner*—Clifford B Vaterlaus
*Attorney, Agent, or Firm*—Zarley, McKee, Thomte Voorhees & Sease; Dennis L. Thomte

[57] ABSTRACT

A clamp ring includes an elongated band formed into the shape of an open generally circular ring with opposing first and second ends. A cam lever is pivotally connected to a first end of the band and a link has one end pivotally connected to the cam lever. The opposite end of the link is connected to the second end of the band such that pivotal movement of the cam lever will selectively draw the ends of the band towards one another to secure the ring in position on a container. A removable handle is provided to engage and pivot the cam lever 20 and includes a polygonal pin for engagement with a corresponding socket on the cam lever.

12 Claims, 5 Drawing Sheets

CLAMPING RING WITH REMOVABLE HANDLE

TECHNICAL FIELD

The present invention relates generally to clamping rings, and more particularly to an adjustable lever lock type clamp ring with a handle which is removable and attachable in a variety of positions.

BACKGROUND OF THE INVENTION

Various types of clamping rings with lever type locks are well known in the field for sealing lids on intermediate bulk containers (IBCs) and the like. However, prior art clamp rings suffer several problems.

Prior art clamp rings utilize a cam type lever in the same plane as the ring, to lock the ring in position. However, cam type levers are difficult to grasp and unlock once clamped to the IBC. Prior art lever lock type clamp rings do not have handles which are conveniently accessed for locking and unlocking the clamp ring.

Prior art clamp rings are also difficult to adjust to the appropriate size for a variety of containers. In most cases, it is necessary to clamp the ring closed on the IBC, to determine whether the ring is of the appropriate size. If not, the ring must be unclamped and adjusted, and then re-clamped to the IBC by trial and error. This is a time consuming process, and can lead to use of an inappropriately sized clamp ring for the particular container.

SUMMARY OF THE INVENTION

It is therefore a general object of the present invention to provide an improved clamp ring with a cam lever locking action.

Another object is to provide an improved clamp ring which includes a removable handle.

A further object of the present invention is to provide an improved clamp ring with a handle which may be connected to the cam lever in a variety of positions.

Still another object is to provide a clamp ring which may be adjusted in size while locked in position on a container.

Yet another object is to provide an improved clamp ring which is simple to use and economical to manufacture.

These and other objects of the present invention will be apparent to those skilled in the art.

The clamp ring of the present invention includes an elongated band formed into the shape of an open generally circular ring with opposing first and second ends. A cam lever is pivotally connected to a first end of the band and a link has one end pivotally connected to the cam lever. The opposite end of the link is connected to the second end of the band such that pivotal movement of the cam lever will selectively draw the ends of the band towards one another to secure the ring in position on a container. A removable handle is provided to engage and pivot the cam lever 20 and includes a polygonal pin for engagement with a corresponding socket on the cam lever.

DESCRIPTION OF THE PREFERRED EMBODIMENT

Figure 1:
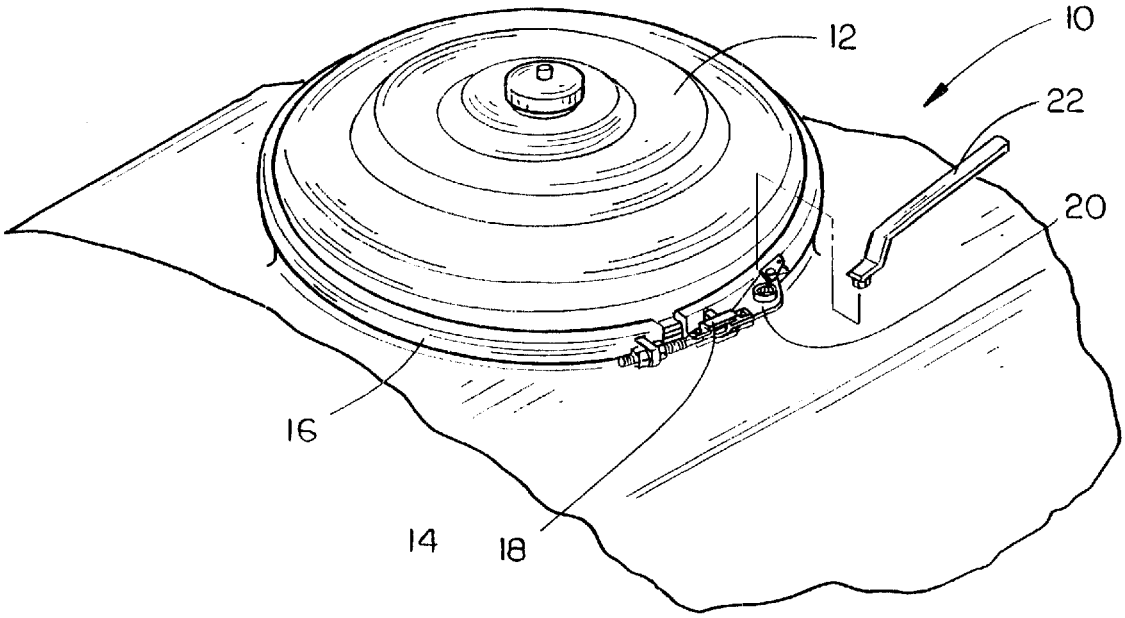
FIG. 1 is a perspective view of the clamp ring of the present invention installed on an IBC.
Figure 2:
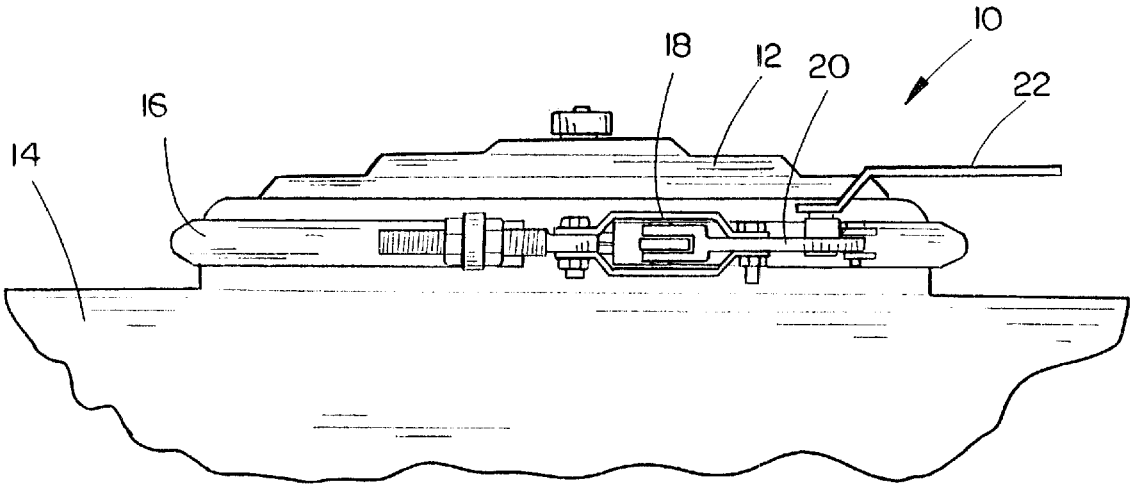
FIG. 2 is an enlarged front elevational view of the clamp ring on an IBC.

Referring now to the drawings, in which similar or corresponding parts are identified with the same reference numeral, and more particularly to FIG. 1, the clamp ring of the present invention is designated generally at 10 and is shown clamped on the disk shaped lid 12 of a conventional intermediate bulk container 14. Clamp ring 10 includes an elongated band 16 extending around a substantial portion of the circumference of lid 12, with a link 18 and cam lever 20 operatively linking the ends of band 16 to seal lid 12 in position. A handle 22 is utilized to operate cam lever 20, as described in more detail hereinbelow. Referring now to FIGS. 2–5, it can be seen that band 16 is generally "C-shaped" in cross-section, to receive the edge of the lid therein. The ends 16*a* and 16*b* of band 16 are disposed adjacent but spaced apart from one another, to form a generally circular shape.

A short arm 24 is mounted on an outward surface 16*c* of band 16 proximate the first end 16*a* of band 16. Cam lever 20 has a proximal end 20*a* pivotally connected to arm 24 with a pivot pin 26, for pivotal movement about a pivot axis orthogonal to a radius of the circular band 16. Thus, cam lever 20 pivots generally within the same plane as the circular band 16.

A socket 28 is mounted on an upper surface 20b of cam lever 20 near the distal end 20*c* thereof. Socket 28 is preferably a 12 point socket, for receiving a hexagonal pin 30 on handle 22. The longitudinal axis of socket 28 is parallel to the pivot axis of cam lever 20 such that hex pin 30 will project upwardly from the plane of the annular band 16.

Handle 22 includes an inward end 22*a* and an outward end 22*b*, with hex pin 30 mounted on the inward end 22*a*. Preferably, handle 22 has a bent portion 32 which offsets the outward end 22*b* relative to the inward end 22*a*, to permit rotation of handle 22 in a plane parallel and spaced upwardly away from the plane of annular band 16.

The use of a hex pin 30 and a 12 point socket 28 permits handle 22 to be connected to socket 28 in twelve different positions. Obviously other polygonal shapes would work equally as well, permitting handle 22 to engage socket 28 and thereby pivot to cam lever 20 about pivot pin 26.

Figure 3:
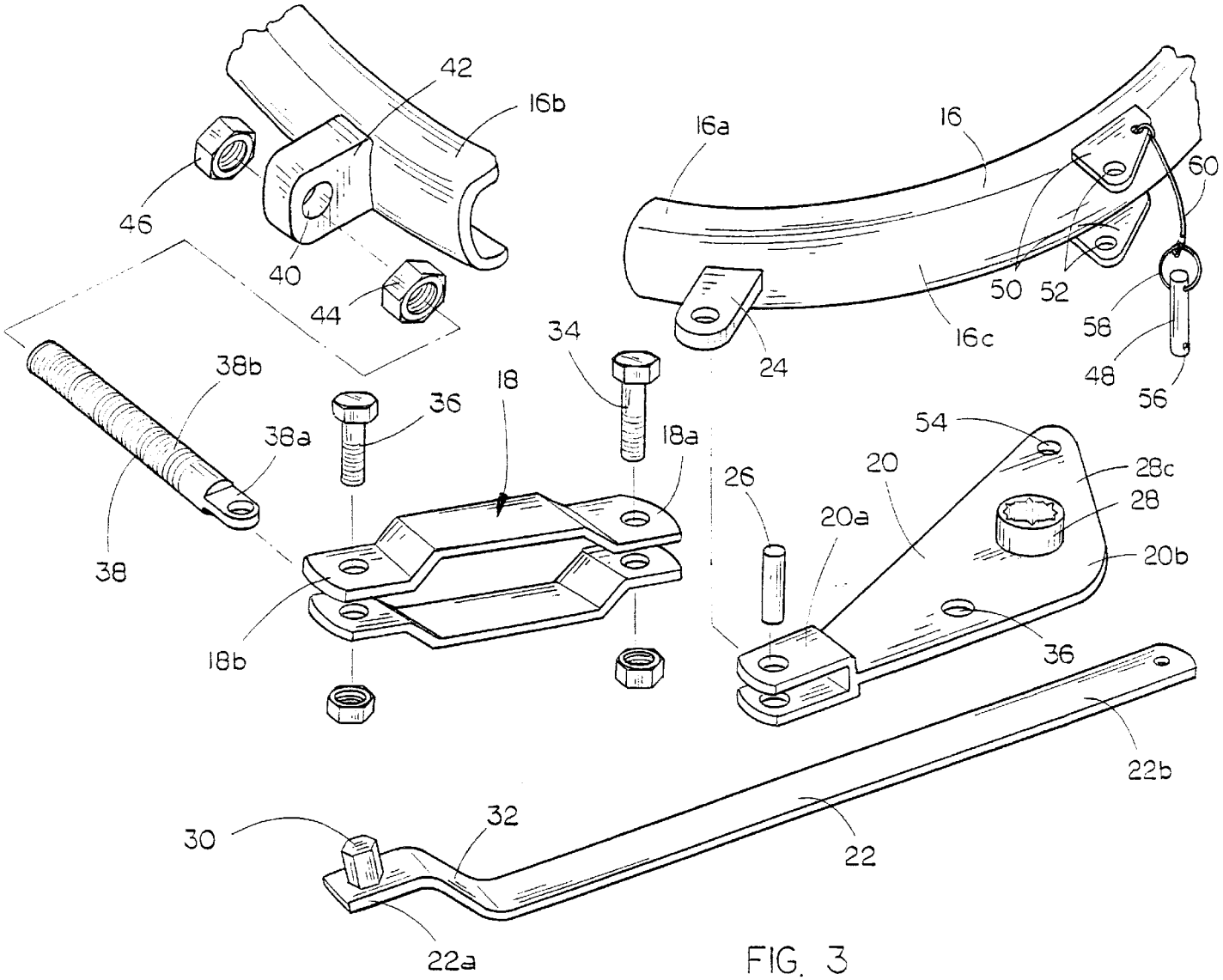
FIG. 3 is an enlarged exploded perspective view of the clamp ring.

Link 18 is pivotally connected at a first end 18*a* to cam lever 20 generally midway between pivot pin 26 and socket 28. As shown in FIG. 3, this pivotal connection is accomplished with a bolt 34 extending through apertures in the first end 18*a* of link 18 and through an aperture 36 in cam lever 20.

The second end 18*b* is pivotally connected by a bolt 36 to one end 38*a* of an adjustment rod 38. Adjustment rod 38 is journaled through an opening 40 formed in lug 42 mounted on the outward surface 16*c* of the second end 16*b* of annular band 16. Rod 38 is slidably journaled through opening 40, and is retained in position relative to lug 42 by a pair of lock nuts 44 and 46 threaded on threads 38*b* on rod 38 and disposed on opposing sides of lug 42. Rotation of lock nuts 44 and 46 in the same direction will thereby cause threaded rod 38 to be moved through lug 40, thereby adjusting the distance between link pivot pin 36 and cam lever pivot pin 26, and effectively adjusting the overall diameter of annular band 16.

Figure 4:
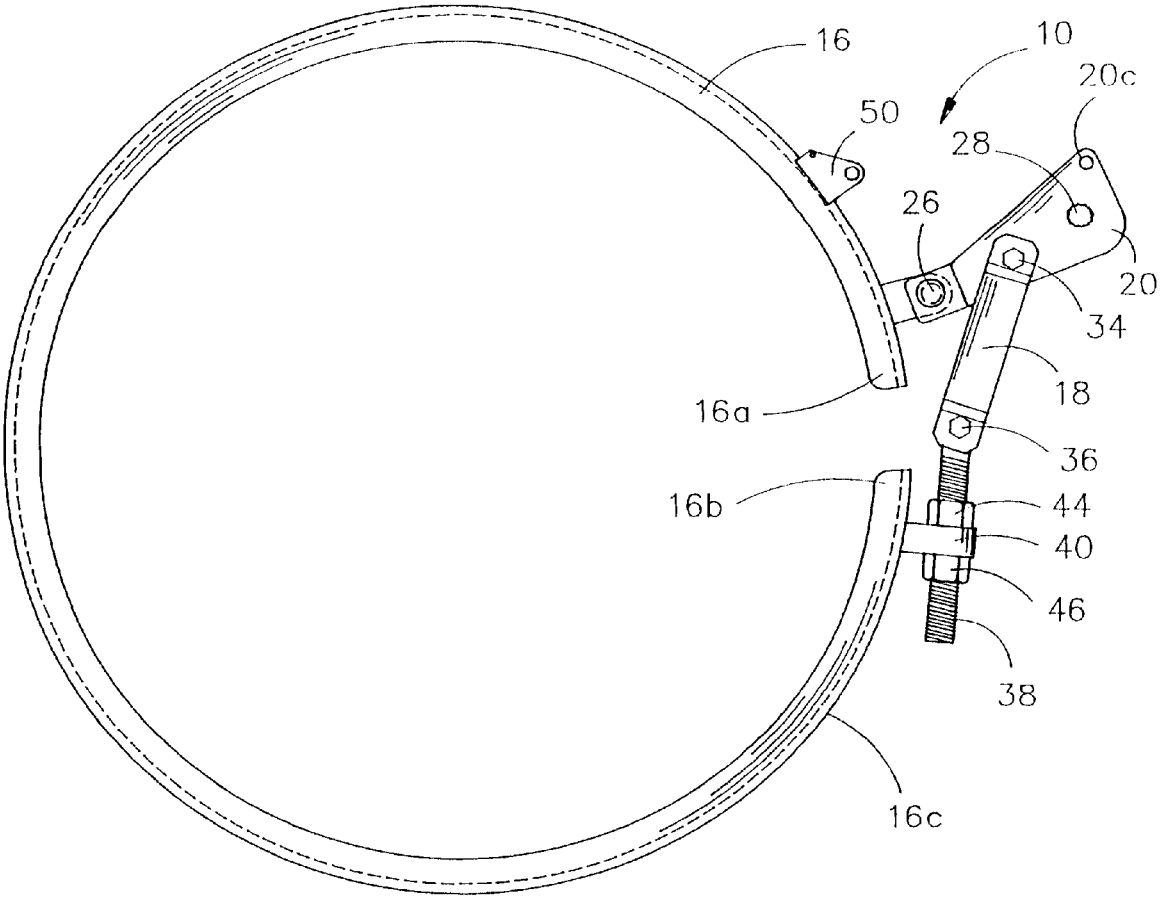
FIG. 4 is a plan view of the clamp ring in the open position.
Figure 5:
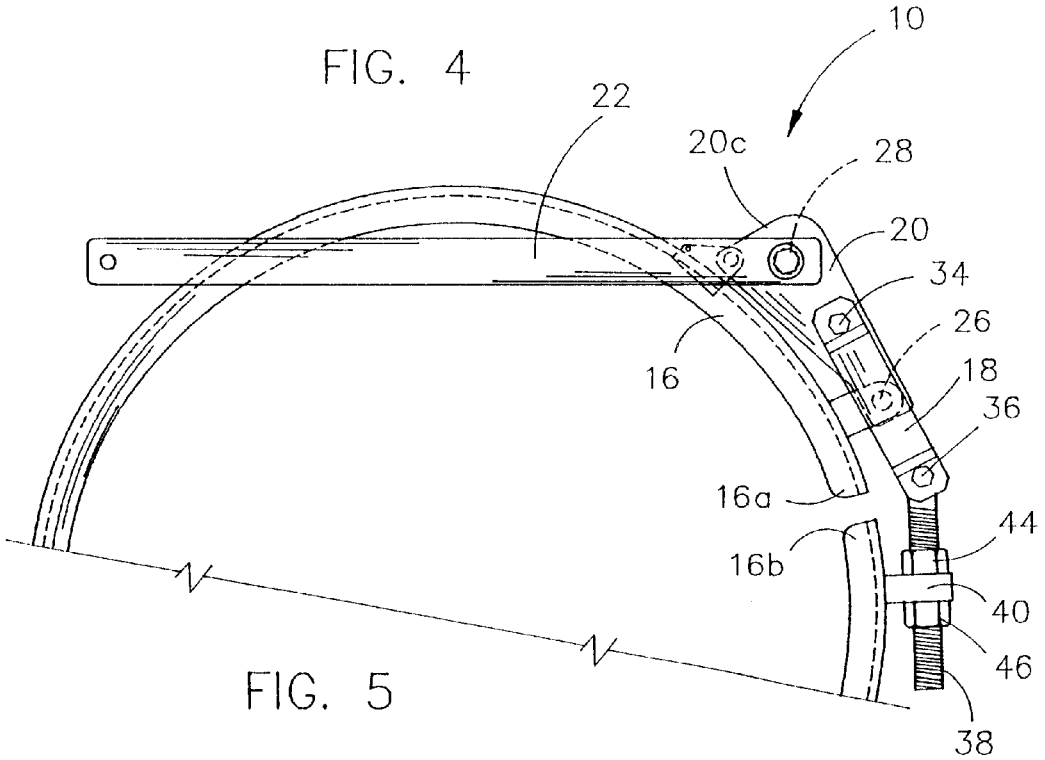
FIG. 5 is a plan view similar to FIG. 4, but showing the clamp ring in the closed position, with the handle in place.

Referring now to FIGS. 4 and 5, the operation of clamp ring 10 is shown in more detail. FIG. 4 shows cam lever 20 pivoted with cam lever distal end 20*c* spaced outwardly away from annular band 16. This moves bolt 34 of link 18 towards the opening between the ends 16*a* and 16*b* of band 16, and simultaneously pushes rod 38 and the second end 16*b* of band 16 away from the first end 16*a* of band 16. Thus, the overall diameter of annular band 16 is increased, so as to "open" the band and release the clamp ring 10 from the lid of a container. In FIG. 4, the handle has been removed from socket 28 to more clearly show the components of clamp ring 10.

In FIG. 5, handle 22 has been engaged in socket 28, and rotated, so as to pivot cam lever 20 on pivot pin 26, to move the distal end 20*c* of cam lever 20 into a position adjacent band 16. Because handle 22 is in a plane parallel and spaced away from the plane of band 16, the handle will not interfere with band 16 as it is being pivoted. The pivot bolts 34 and 36 at the ends of link 18 are positioned so as to be located generally radially inwardly relative to the pivot pin 26 of cam lever 20, as shown in FIG. 5, such that any force on band 16 which biases band 16 outwardly to increase the diameter of the annular band will cause the cam lever 20 to become more securely locked. Thus, to release the clamp ring 10 from the closed position shown in FIG. 5, cam lever 20 must be pivoted outwardly away from band 16, to cause the ends 16*a* and 16*b* of band 16 to be drawn slightly towards one another before being released and spaced away from one another.

Once clamp ring 10 has been moved to the closed position shown in FIG. 5, handle 22 may be removed, because of the positive locking action of the cam lever 20 and link 18. Handle 22 may be engaged in socket 28 in any of a variety of orientations, because of the polygonal shape of socket 28 and hex pin 30 (shown in FIG. 3).

In order to add additional security and safety, a locking pin 48 is provided, as shown in FIG. 3, to secure cam lever 20 in the closed position. A pair of spaced apart lugs 50 having coaxial apertures 52 are mounted on band 16 at a position aligned with an aperture 54 on the distal end 20*c* of cam lever 20, when cam lever 20 is moved to the closed position. Pin 48 may then be secured through the apertures 52 in lugs 50 and the aperture 54 in cam lever 20, to retain cam lever 20 in the closed position. A spring loaded ball 56 in one end of pin 48 prevents accidental removal of pin 48 in one direction, while a ring 58 in the other end of pin 48 prevents the pin from sliding through the apertures in the opposite direction. Although a pair of lugs 50 are illustrated, a single lug 50 may also be utilized. A short safety cable 60 connected between a lug 50 and ring 58 retains pin 48 in close proximity to lugs 50, for convenient use.

Figure 6:
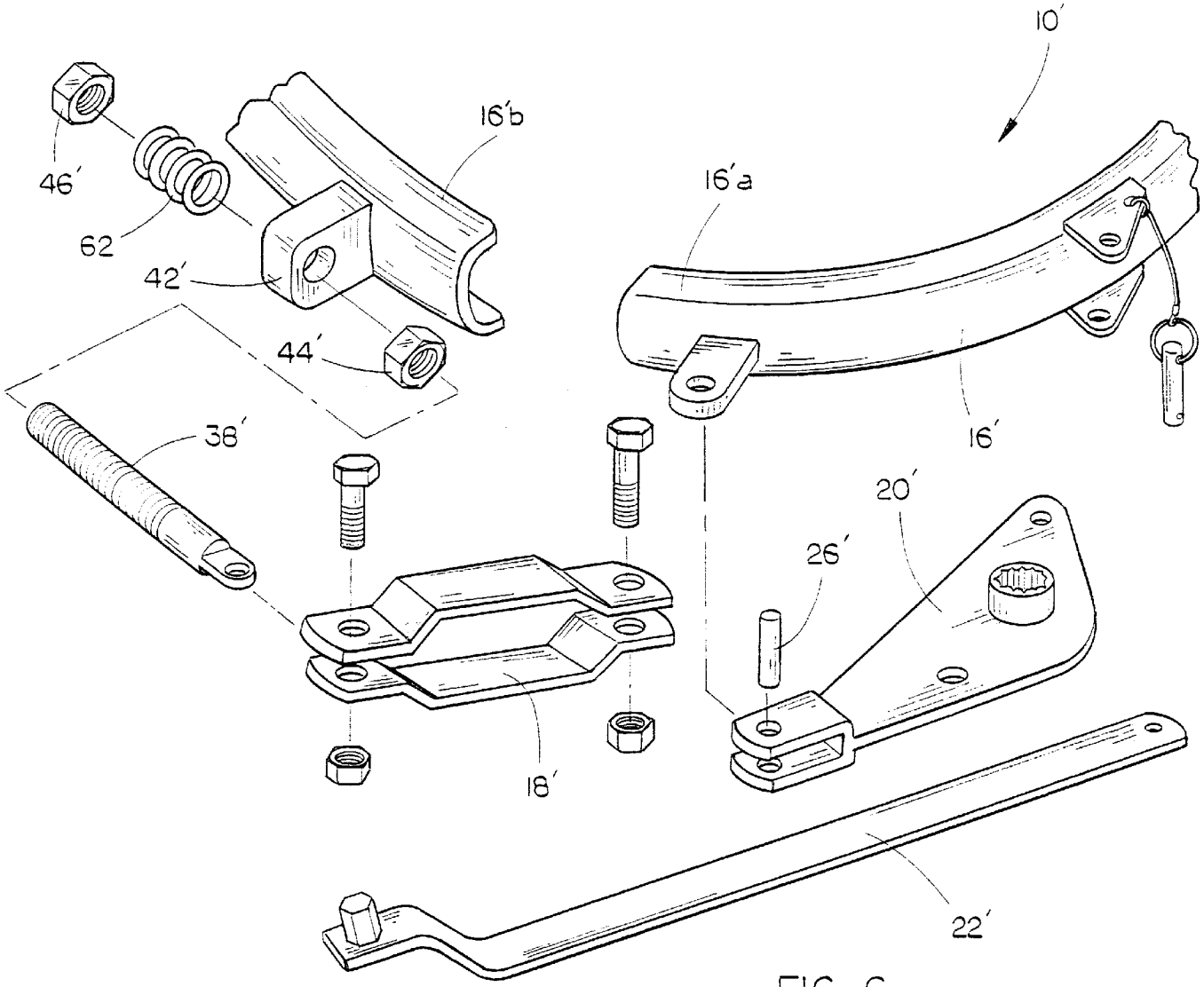
FIG. 6 is an enlarged exploded perspective view of the second embodiment of the clamp ring.
Figure 7:
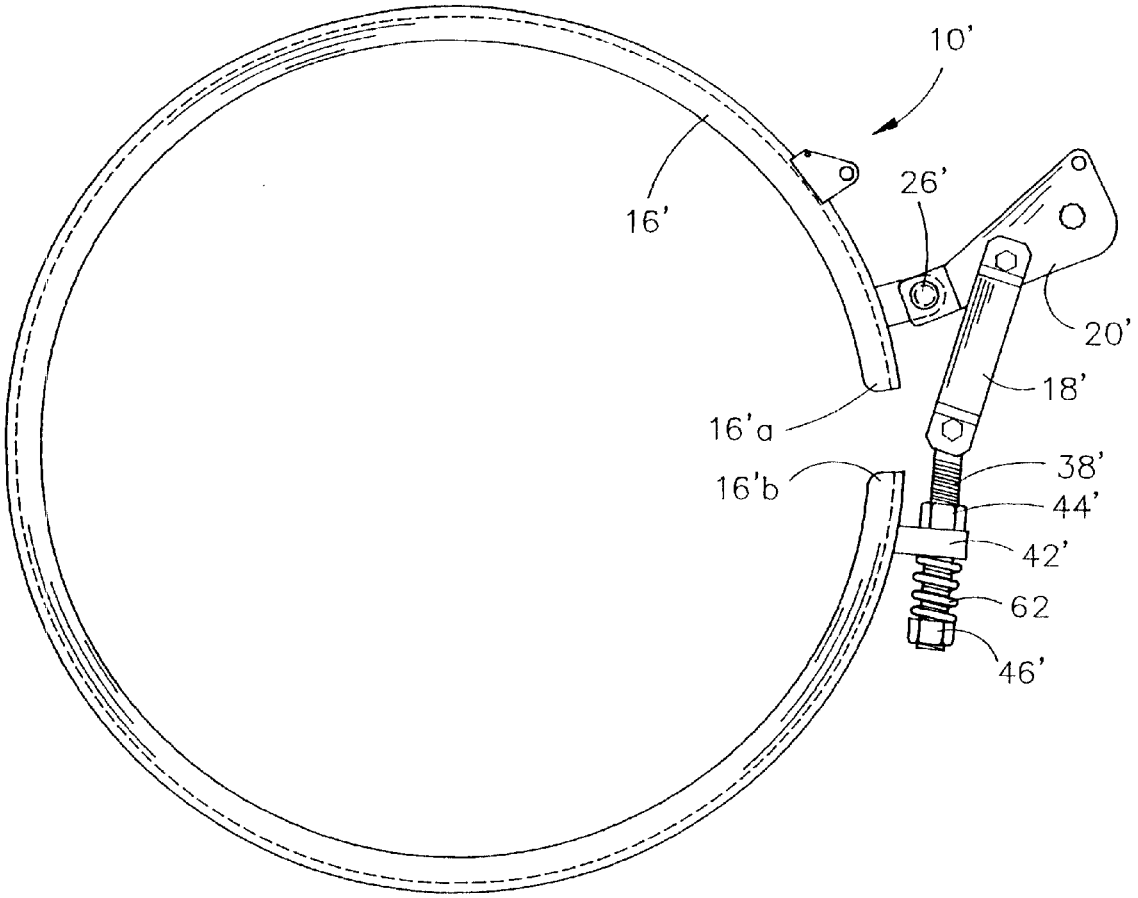
FIG. 7 is a plan view of the second embodiment of the clamp ring, with the ring in the open position.
Figure 8:
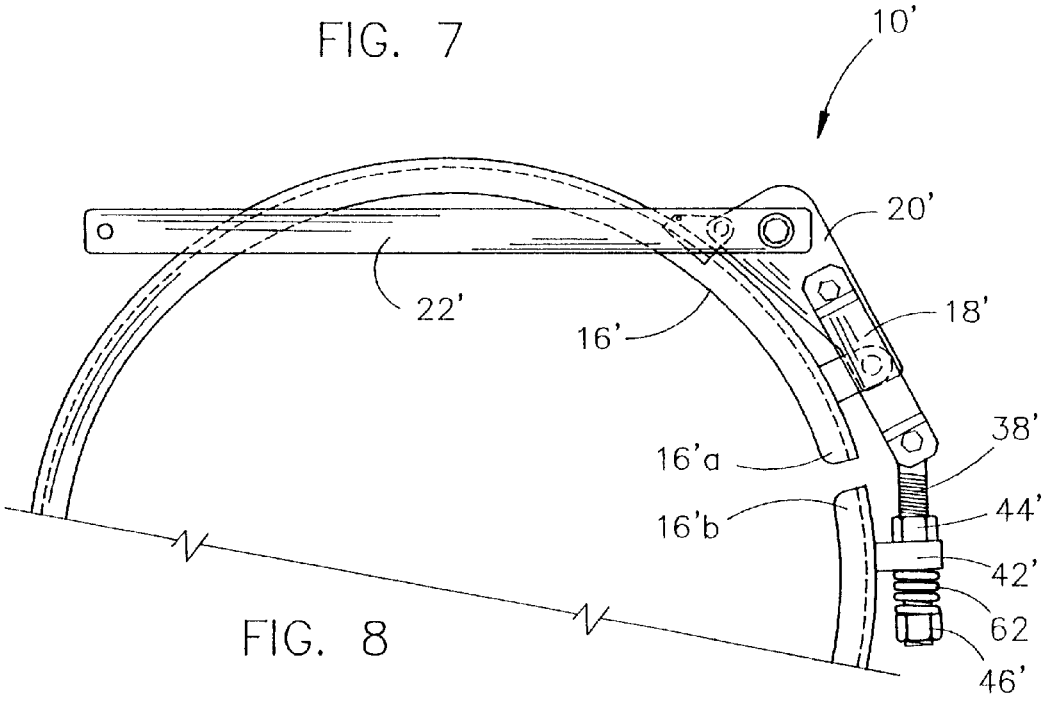
FIG. 8 is a plan view similar to FIG. 7, but with the clamp ring in the closed position.

Referring now to FIGS. 6–8, a second embodiment of the clamp ring is designated generally at 10' and includes all of the same components as the first embodiment of the invention. Thus, clamp ring 10' includes an annular band 16' with ends 16'*a* and 16'*b* selectively drawn towards and away from one another by a cam lever 20' pivotally secured by a pivot pin 26' to band end 16'*a*. Link 18' is pivotally connected at one end to cam lever 20' and pivotally secured to a threaded rod 38' at the other end. Threaded rod 38' is slidably journaled through an opening in lug 42' and adjustably secured by lock nuts 44' and 46' on opposite sides of lug 42'.

The second embodiment of clamp ring 10' differs from the first embodiment in the use of a coil spring 62 interposed on rod 38' between lug 42' and lock nut 46'. Lock nut 46' is spaced away from lug 42' such that spring 62 will apply a biasing force against lock nut 46' to force the lock nut away from lug 42'. This in turn applies a biasing force on threaded rod 38' and link 18' to urge the band ends 16'*a* and 16'*b* towards one another. Not only will spring 62 provide a self-adjusting tension on clamp ring 10', but will also assist in permitting the clamp ring to be tightened more securely while in the locked position, shown in FIG. 8.

Whereas the invention has been shown and described in connection with the preferred embodiment thereof, many modifications, substitutions and additions may be made which are within the intended broad scope of the appended claims.

We claim:

1. A clamp ring, comprising:

an elongated band formed into the shape of an open, generally circular ring, with opposite first and second ends spaced from one another, said band having an inward face and an outward face;

a link having first and second ends, the first end pivotally connected to said band first end on a pivot axis orthogonal to a radius of said circular band;

a cam lever, having first and second ends, said first end pivotally connected to said band second end on a pivot axis parallel to said link first end pivot axis;

said link second end pivotally connected to said cam lever between said cam lever pivot axis and said cam lever second end;

said cam lever being operable between a first open position in which the extent of said cam lever diverges from said band, and a second closed position in which said lever second end is positioned adjacent said band and said link ends are positioned on opposite sides of said lever pivot axis; and radially inwardly of said lever pivot axis, to draw said band first end toward said band second end; and an elongated handle having a first end removably connected to said lever second end, and a second end projecting outwardly form said first ends in a plane substantially parallel to a plane formed by said circular band;

said handle connected to said lever to pivot said lever on said lever pivot axis;

said cam lever second end including a first half of a cooperable connector;

said handle first end including a second half of said cooperable connector, for selective cooperable connection of said handle to said lever in one of a plurality of positions.

2. The clamping ring of claim 1 wherein said cooperable connector first half includes a polygonal socket with an axis orthogonal to a radius of the circular band, and wherein the cooperable connector second half includes a polygonal pin removably journaled within the socket.

3. The clamping ring of claim 1, further comprising means selectively connected between the band and the cam lever for selectively locking the lever in the closed position.

4. The clamping ring of claim 3, wherein said selective locking means includes:

a lug mounted on the band, said lug having an aperture formed therethrough;

said cam lever having an aperture formed therethrough, positioned for alignment with the lug aperture when the cam lever is in the closed position; and a locking pin selectively, slidably journaled through the cam lever aperture and the lug aperture.

5. The clamping ring of claim 4, further comprising means connecting the link pivot axis to the band first end, for selectively adjusting the diameter of the circular band while the lever is in the closed position.

6. The clamping ring of claim 5, wherein said diameter adjusting means includes:

a rod with a pin orthogonally mounted on a first end, said pin pivotally connected to the link first end to form the link first end pivot axis;

an annular lug affixed to the band first end for receiving the rod; and means on the rod for selectively adjustably connecting the rod to the annular lug, to permit adjustment of the distance between the annular lug and the pin on the rod.

7. The clamping ring of claim 6, wherein said means for selectively, adjustably connecting the rod to the annular lug includes:

said rod having threads formed thereon from the pin to the second end thereof;

said rod being slidably journaled through said annular lug; and first and second threaded lock nuts threaded on the rod threads, one lock nut disposed on opposing sides of the annular lug.

8. The clamping ring of claim 7, wherein the first lock nut is disposed on a proximal link side of the annular lug and the second lock nut is disposed on a distal side of the annular lug, and further comprising biasing means interposed between the second lock nut and the annular lug, for biasing the second lock nut distally away from the annular lug and thereby applying a force biasing the band ends towards one another.

9. The clamping ring of claim 1, further comprising means connecting the link pivot axis to the band first end, for selectively adjusting the diameter of the circular band while the lever is in the closed position.

10. The clamping ring of claim 9, wherein said diameter adjusting means includes:

a rod with a pin orthogonally mounted on a first end, said pin pivotally connected to the link first end to form the link first end pivot axis;

an annular lug affixed to the band first end for receiving the rod; and means on the rod for selectively adjustably connecting the rod to the annular lug, to permit adjustment of the distance between the annular lug and the pin on the rod.

11. The clamping ring of claim 10, wherein said means for selectively, adjustably connecting the rod to the annular lug includes:

said rod having threads formed thereon from the pin to the second end thereof;

said rod being slidably journaled through said annular lug; and first and second threaded lock nuts threaded on the rod threads, one lock nut disposed on opposing sides of the annular lug.

12. The clamping ring of claim 11, wherein the first lock nut is disposed on a proximal link side of the annular lug and the second lock nut is disposed on a distal side of the annular lug, and further comprising biasing means interposed between the second lock nut and the annular lug, for biasing the second lock nut distally away from the annular lug and thereby applying a force biasing the band ends towards one another.

* * * * *